United States Patent [19]

Maisch

[11] Patent Number: 4,580,388

[45] Date of Patent: Apr. 8, 1986

[54] ANGLED PROFILE

[75] Inventor: Walter Maisch, Gaggenau, Fed. Rep. of Germany

[73] Assignee: Profil-Vertrieb GmbH, Gaggenau, Fed. Rep. of Germany

[21] Appl. No.: 677,066

[22] Filed: Nov. 30, 1984

[30] Foreign Application Priority Data

Dec. 21, 1983 [DE] Fed. Rep. of Germany ..... 3346171

[51] Int. Cl.[4] ..... E04C 3/30

[52] U.S. Cl. ..... 52/739; 72/180

[58] Field of Search ..... 52/737–739, 52/731, 732; 72/52, 180; 138/168, 173; 238/77

[56] References Cited

U.S. PATENT DOCUMENTS

| | | | |
|---|---|---|---|
| 489,498 | 1/1893 | Pruden | 72/52 |
| 1,072,932 | 9/1913 | Fairweather | 238/77 |
| 1,179,820 | 4/1916 | Gilliland | 52/737 |
| 1,890,077 | 12/1932 | Elting | 72/52 |
| 2,068,022 | 1/1937 | Hammel | 138/173 |
| 2,180,317 | 11/1939 | Davis | 52/334 |
| 3,165,815 | 1/1965 | Wogerbauer | 72/180 |
| 3,243,930 | 4/1966 | Slowinski | 52/363 |
| 4,069,638 | 1/1978 | Hasselqvist et al. | 52/731 |
| 4,144,369 | 3/1979 | Wass | 52/336 |

*Primary Examiner*—James L. Ridgill, Jr.
*Attorney, Agent, or Firm*—Erwin S. Teltscher

[57] ABSTRACT

In a lightweight longitudinal angled section, particularly a cover-carrying profile, which includes two legs spaced from one another extending along the longitudinal direction, wherein a longitudinal bar connects the legs, and each leg is formed with stiffening devices, which, in turn, include at least one longitudinal impression, each leg has a free longitudinal end facing away from the bar, and wherein the free longitudinal end is formed with a longitudinal flange extending approximately parallel with the bar so as to face inwardly, the improvement includes longitudinal edge portions connecting respective legs to the bar, corrugations which extend transverse to the longitudinal direction along each leg up to the longitudinal impressions, and therebeyond to the longitudinal edge portions, and at least partly over a portion of the width of the bar, and wherein the corrugations are spaced from one another at substantially identical distances.

8 Claims, 4 Drawing Figures

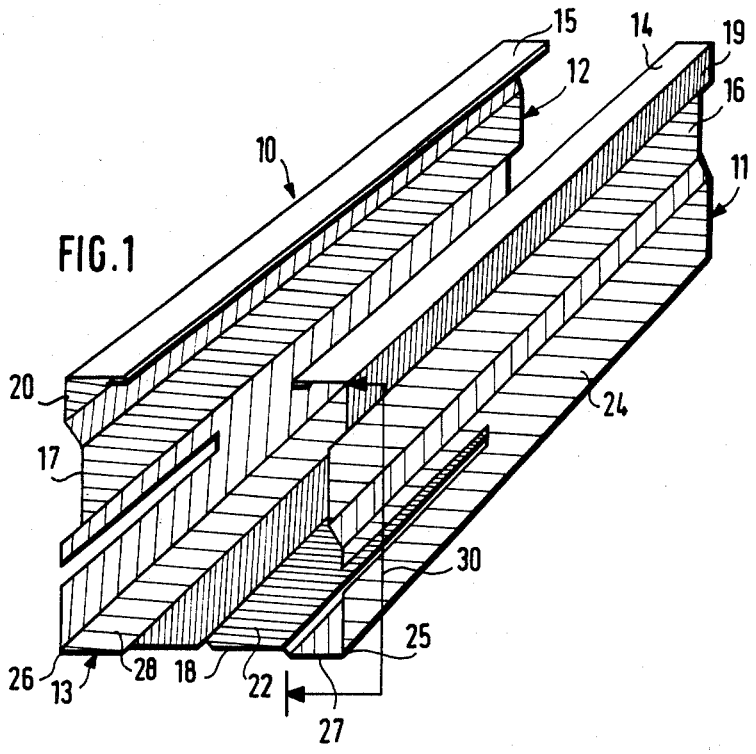
FIG.1
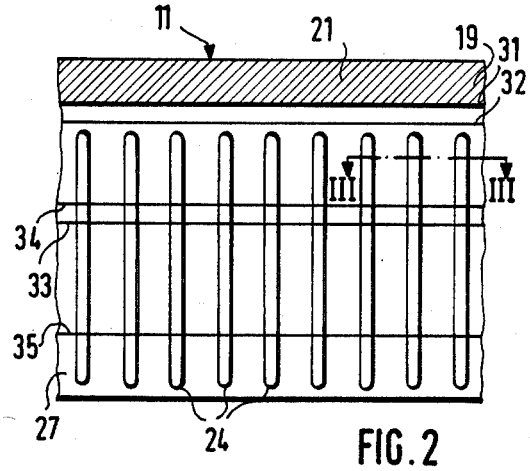
FIG.2
FIG.4
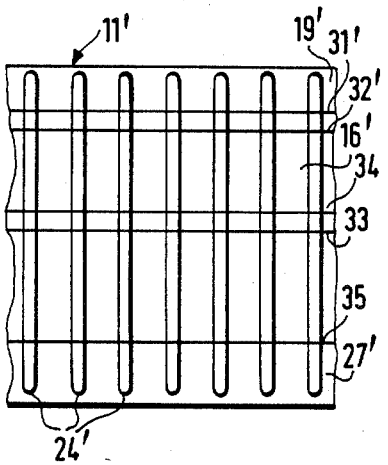
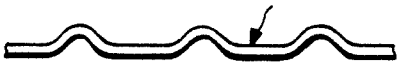
FIG.3

ANGLED PROFILE

BACKGROUND OF THE INVENTION

The invention relates to an angled profile or section implemented as a light construction profile, particularly as a cover-carrying section, with two legs spaced from one another extending in the longitudinal direction, and wherein the legs are connected by means of a longitudinal bar, with at least one longitudal impression or embossment acting as a stiffener provided in the section extending in the longitudinal direction thereof, and wherein the free longitudinal ends of the legs remote from the bar are each formed with a flange facing inwardly, extending approximately parallel to the bar and in the longitudinal direction of the section.

Sections of this type, and also their use as cover-carrying sections of profiles are known. Particularly in the case of cover-carrying profiles of sections which conventionally have C-shaped cross sections, one deals, as a rule, with rolled sections manufactured from thin metal sheets, whose legs are connected to one another through a longitudinal bar, are formed at the ends facing away from the bar with inwardly directed flanges, and are consequently stiffened thereby.

Thus from U.S. Pat. No. 3,243,930 a section of this type has become known, in which two legs extending in parallel are connected with one another through a bar, and wherein a longitudinally extending flange is formed onto the free ends of the legs extending in parallel with the bar. Furthermore, longitudinal impressions extend along the legs in the form of grooves running parallel to one another. This feature, although resulting in a certain stiffening of the section, is nevertheless inadequate, when using such sections as cover-carrying profiles. The profile section known from the prior art is intended for construction of walls, and in the case of grooves extending along the longitudinal direction of the profile in the legs, one deals with centering aids for starting the tapping-in of screws having self-cutting threads.

It has been shown that inspite of any stiffening flanges formed on the free ends of the legs during installation of such profile sections as cover-carrying profiles, these are frequently damaged, if the profiles or sections, after being installed, are subjected to forces acting transverse to the longitudinal direction of the sections. Such stresses may occur, for example when installed sections of this type are walked on, and where the flanges, which then face upwardly, and border a longitudinal gap formed in the section, serve as walking surfaces.

SUMMARY OF THE INVENTION

The object of the invention is to obviate any deficiencies in such profiles or sections, and to create an improved profile or section, as far as its stability, shape, carrying capability and stiffness are concerned, so that it represents an improvement with respect to the prior art.

This object is attained in a profile or section implemented as a light profile, particularly in a cover-carrying profile of the initially described type, by the legs being provided, in addition to the longitudinal impressions, with transverse corrugations substantially extending at equal respective distances transverse to the longitudinal direction of the section up to the stiffening longitudinal impressions of the legs, beyond the longitudinal edges connecting the legs with the bar, and at least over part of the width of the bar.

From U.S. Pat. No. 4,144,369 a cover-carrying profile has become known, where there are provided legs diverging from several bars, wherein the latter are spaced parallel from one another, and wherein the bars, which connect the legs, are in turn provided with stiffening impressions; however, one deals here with a constructionally complicated sheet metal portion, in which the stiffening impressions are formed at predetermined respective distances from one another, so as to project from the planes of the legs and bars, and wherein there extend between these impressions non-deformed rib-like segments in the planes of the legs and the bars. This cover-carrying profile of the prior art cannot be compared to the inventive profile or section, and the above-noted reference, in particular, does not suggest any features to an ordinary person skilled in the art of how to realize the inventive stiffening means in a simple C-shaped profile, with transverse corrugations extending between the legs and the bar beyond the longitudinal edges. But this very implementation of the corrugations extending beyond the aforedescribed longitudinal edges, and over a part of the width of the bar is, in fact, essential for the inventive stiffening.

One version of the invention provides that the transverse corrugations are formed so as to extend outwardly from the legs and from the bar, and so as to project beyond the planes defined or formed by the legs or the bar, which in the case of any affixation of constructional plates to the profile permits the holding thereof without any surface abutting to the legs or to the bar. Consequently the formation of any icing (cold bridges), and transmission of sound through any solid body are considerably reduced thereby.

According to a further embodiment, and within the scope of the present invention, an arrangement can also be implemented wherein in a longitudinal center portion of the bar, and at a distance from the legs, there extends in the direction of the profile a longitudinal impression, and wherein the transverse corrugations extend up to that longitudinal impression. This longitudinal impression in the center portion of the bar can furthermore be provided with a herring-bone patterned embossment or indentation, which, in turn, facilitates threading in of screws having self-winding threads; hence this feature, in addition to its function in facilitating centering of the screws, when such screws are tapped in, aids in improving the stiffness of the section. In a similar manner herring-bone embossments can be impressed onto segments which extend between the stiffening longitudinal impressions and the inwardly extending flanges.

According to a further embodiment of the invention, the transverse corrugations can also extend beyond the stiffening longitudinal impressions approximately up to the flanges, which are formed onto the free ends of the legs remote from the bar.

BRIEF DESCRIPTION OF THE DRAWING

The present invention is further explained with the aid of the appended drawings by means of two embodiments, in which:

FIG. 1 is a perspective view of a cover-carrying profile having a C-shaped cross-section, in which the legs along a portion of their height, as well as respective rim strips connecting the legs to the bar are provided with transverse corrugations extending along the legs at right angles to the longitudinal direction of the section;

FIG. 2 is a side view of one leg with the corrugations spaced from one another, together with the rim strip folded into the plane of the legs, bordering the legs, and also provided with transverse corrugations, FIG. 3 is a large scale longitudinal section along the line III—III of the development according FIG. 2, with the transverse corrugations being impressed thereinto, and, FIG. 4 is a side view which corresponds to that of FIG. 2, but showing an arrangement of transverse corrugations extending over the entire height of the legs.

DESCRIPTION OF THE PREFERRED EMBODIMENTS

In the cover-carrying profile or section 10 one deals with a C-shaped profile, whose legs 11 and 12, which extend along the longitudinal direction of the section 10 parallel to one another, are connected by means of a bar 13; the ends facing away from the bar 13, in turn, face one another, and have respective flanges 14 and 15 formed thereonto, which extend parallel with the legs 11 and 12. The legs 11 and 12 are provided in the regin between the flanges 14 and 15 and the bar 13 with stiffening longitudinal impressions 16 and 17. A similar longitudinal impression or indentation 18 extends in the center region of the bar 13 along the longitudinal direction of the section 10. The longitudinal indentation 18 in the center portion of the bar 13, the strip-like segments 19 and 20 of the legs extending between the longitudinal impressions 16 and 17 and the flanges 14 and 15 are provided on the exterior with herring-bone impressions or embossments 21 and 22, which facilitate the use and tapping in of screws having self-cutting threads. Furthermore the legs 11 and 12 are provided therebeyond with lateral stiffening corrugations 24, which are spaced from one another at respective equal distances, and extend continuously along the strip-like segments 19 and 20 of the legs through and beyond the longitudinal impressions 16 and 17 until the longitudinal edges 25 and 26, respectively, within the region of the bar 13; each corrugation, in turn, extends up to respective rim strips 27 and 28 of the bar, and each rim strip 27 and 28 borders respective legs 11 and 12.

The arrangement of the identical transverse corrugations are shown particularly well in FIGS. 2 and 3. The transverse continuously 20 are fabricated prior to forming the longitudinal impressions 16 and 17, and prior to the formation of the legs 11 and 12 extending from the bar 13. They extend through the longitudinal impressions 16 and 17 of the legs, and up to the longitudinal impression or indentation 18 in the longitudinal center portion of the bar 13.

FIG. 2 shows the development only indicated in FIG. 1 by the reference numeral 30 of the legs 11 with the rim 27 bordering the longitudinal edge 25 of the bar 13; the transverse transitions between any material remaining in the plane of the leg are indicated by the auxiliary lines 31 and 32, on one hand, and 33 and 34, on the other hand, and wherein the longitudinal edge 25 is indicated by the auxiliary line 35. As has already been indicated, it is of importance that the transverse corrugations 20 are also formed in the region of the longitudinal impressions 16 and 17 in the leg material, and also extend through the longitudinal edges 25 and 26 between the legs 11 and 12, and the bar 13. The herring-bone indentation or embossment pattern 21 in the strip-shaped segment 19 between the longitudinal embossment 16 and the flange 14 formed onto the leg 11 is also shown in FIG. 2.

In this embodiment, as shown in FIG. 3, the transverse corrugations 24 are formed from the leg material so as to be embossed towards the interior. It will be understood that within the scope of the invention an embodiment is also possible, wherein the corrugations are formed so as to be embossed or protrude from the legs 11 and 12 outwardly, namely they extend outwardly from a plane defined by any non-deformed leg material, so that any constructional plates fastened to the legs are made to extend from the legs by the measure of these projections; this has been shown to be advantageous, not only in view of the desirable avoidance of any icing (cold bridges), but also as an aid in reducing any transmission of sound through a solid.

In the embodiment shown in FIG. 4 similar reference numerals have been used as those pertaining to FIGS. 1 and 3, except that they have been denoted as prime numerals, so as to differentiate them from the earlier described numerals.

In the embodiment according to FIG. 4, and differing here from the previously described embodiments, the transverse corrugations 24' extend beyond the longitudinal impressions 16' in the leg 11' up to the strip-like segment 19, which in turn extends on the side facing away from the bar 13 of the longitudinal impression 16'. The transverse corrugations 24' consequently extend approximately up to the flange formed onto the end of the leg 11' remote from the bar 13, and extend continuously within the region of the longitudinal impressions 16'.

In connection with the flanges formed onto the free ends of the legs, which serve as a longitudinal stiffening of the C-shaped cover-carrying profiles, the longitudinal impressions formed onto the legs, and the longitudinal impressions in the center portion of the bar, the transverse corrugations 20 and 20' ensure a sufficient form stability when they are stressed and used for what they were designed for, and consequently enhance both the stiffness and carrying-capibility of such sections. If the transverse corrugations 20 and 20' are formed so as to project from the leg material outwardly, they permit the securement of any constructional plates fastened onto the sections at a spacing therefrom, which in turn leads to a reduction of any icing (cold bridges) and any sound transmissions through a solid, as well as ensures an improved resistance to fire. Equipping partial regions of the bar and/or of the legs with a herring-bone patterned embossment permits an easier attachment of constructional plates by means of screws with self-cutting threads, as these may then be secured to the section in a trouble-free manner within the region of the herringbone embossments, and may be taped or threaded into the section material.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. In a lightweight longitudinal angled section, particularly a cover-carrying profile, including two legs spaced from one another, and extending along the longitudinal direction, a longitudinal bar connecting said legs, each leg being formed with stiffening means, including at least one longitudinal impression, and having a free longitudinal end facing away from said bar, said longitudinal end being formed with a longitudinal flange extending approximately parallel with said bar and facing inwardly, the improvement comprising longitudinal edge portions connecting respective legs to said bar, corrugations extending transverse to said longitudinal direction continuously (a) along each leg up to said longitudinal impressions, (b) therebeyond to said longitudinal edge portions, and (c) at least partly over a portion of the width of said bar, said corrugations being spaced from one another at substantially identical distances, whereby stability, carrying capacity and stiffness of said angled section is improved, particularly with respect to forces, such as walking forces, acting on said flanges in a direction transverse to said longitudinal direction.

2. The angled section as claimed in claim 1, wherein said corrugations extend inwardly, whereby inward ice formation on said angled section, and transmission of sound therethrough is reduced.

3. The angled section as claimed in claim 1, wherein said corrugations extend outwardly, whereby outward ice formation on said angled section, and transmission of sound therethrough, is reduced.

4. The angled section as claimed in claim 1, wherein said corrugations are formed so as to project outwardly from said legs and from said bar.

5. The angled section as claimed in claim 1, further including a longitudinal indentation in a center portion of said bar, and being spaced away from said legs, said corrugations extending up to said longitudinal indentation.

6. The angled section as claimed in claim 1, wherein said longitudinal corrugations extend continuously beyond said longitudinal impressions along said legs approximately up to the respective flanges.

7. The angled section as claimed in claim 5, wherein said longitudinal indentation is formed with a herring-bone pattern in a center strip of said bar so as to facilitate threading screws having self-winding threads thereinto.

8. The angled section as claimed in claim 1, further comprising a longitudinal segment extending between each longitudinal impression and a corresponding inwardly projecting flange, each longitudinal segment being formed with a herring-bone pattern.

* * * * *